United States Patent [19]

Mumford et al.

[11] 4,383,619

[45] May 17, 1983

[54] CONVERTIBLE CHILD-RESISTANT CLOSURE ASSEMBLY

[75] Inventors: George V. Mumford, Toledo; James H. Price, Maumee, both of Ohio

[73] Assignee: Owens-Illinois, Inc., Toledo, Ohio

[21] Appl. No.: 263,439

[22] Filed: May 14, 1981

[51] Int. Cl.[3] ..... B65D 55/02

[52] U.S. Cl. ..... 215/222; 215/211

[58] Field of Search ..... 215/211, 222, 224, 347, 215/348

[56] References Cited

U.S. PATENT DOCUMENTS 4,059,198 11/1977 Mumford ..... 215/211 X

*Primary Examiner*—George T. Hall

*Attorney, Agent, or Firm*—J. R. Nelson; M. E. Click; D. H. Wilson

[57] ABSTRACT

A two member child-resistant closure assembly including an outer shell and an inner resilient closure retained therein. In the child-resistant mode, the resilient inner closure spring biases the outer shell into locking engagement with lugs formed on a cooperating container. A handling ring is provided for removing the inner closure for use separately as a snap cap. For this purpose, the inner closure includes an annular plug, and a short annular skirt arranged to engage the container rim.

2 Claims, 3 Drawing Figures

CONVERTIBLE CHILD-RESISTANT CLOSURE ASSEMBLY

BACKGROUND OF THE INVENTION

1. Field of the Invention

The invention relates to a two member child-resistant closure one member of which can be used separately as a closure which is not child-resistant.

2. Description of the Prior Art

Child-resistant closures have long been in use to prevent access by children to harmful substances, such as medicines, in containers closed by such closures. Governmental regulations require many substances to be packaged in child-resistant containers. Child-resistant closures typically require a particular complex set of manipulations to affect removal. A practical child-resistant closure is not only difficult or impossible for a child to remove, but is relatively easy for an adult user to remove.

Many prior designs of child-resistant closures have not met this last criterion. Some designs have required for their removal strength or dexterity beyond the capacity of some adult users, for example, the elderly or those afflicted with arthritis. Therefore, there have recently been proposed child-resistant closures which can be supplied by the pharmacist in a child-resistant mode, but which can be converted by the consumer for reuse without the child-resistant feature.

A convertible closure is described in U.S. Pat. Nos. 3,865,287, and Re. 29,779, both to Morris. Morris discloses a unitary reversible closure, having two independent positions of use for sealing a container, one of which is child-resistant, and the other of which is not child-resistant. No manipulation of the closure, other than its inversion, is necessary to reseal a container such that it is not child-resistant. Hence, there is the danger that some users would make this simple conversion without pausing to consider whether the child-resistant mode should be utilized instead. Moreover, the commercial embodiment of the Morris invention utilizes a resilient pawl as a child-resistant locking means. Such a design is not as child-resistant as tow piece closures.

An effective two piece child-resistant closure is disclosed in U.S. Pat. No. 4,059,198, to Mumford. It is possible to apply this closure without engaging the locking means, such that it is retained on a cooperating container by an interference fit only. However, in such a situation, the retention of the closure on the container is not secure. Moreover, there is no visual indication that the container and closure are not child-resistant.

SUMMARY OF THE INVENTION

The invention provides an improvement in a two piece child-resistant closure of the type disclosed in the aforesaid U.S. Pat. No. 4,059,198, wherein the inner resilient liner is removable and usable separately as a snap cap.

A container for the closure comprises a cylindrical neck having circumferentially spaced, outwardly projecting locking lugs on its outside cylindrical surface, adjacent the rim. The lugs include downwardly opening notches.

The closure includes an outer shell having a disc shaped panel, and an annular skirt depending from the periphery of the panel. Circumferentially spaced keys extend radially inwardly from the inside cylindrical surface of the skirt, for engagement with the notches. A downwardly depending annular rim or abutment is integrally formed with the panel of the outer shell.

A resilient, generally disc shaped inner closure is retained within the outer shell between the abutment and the inwardly projecting keys. When the closure assembly is applied in the child-resistant mode, the resilient inner closure is distorted between the abutment and the container rim, thereby providing an upwardly directed spring bias to the outer shell, to retain the keys within the notches.

The inner closure includes an integrally formed handling ring, by which it can be conveniently manually removed from the outer shell. An integral depending plug is formed in the inner closure, sized for an interference fit within the inside cylindrical surface of the container. Unlike the inner resilient liner in the prior art two piece closures, the resilient inner closure also includes an integral, short depending skirt constructed and arranged to fit snugly around the rim of the container, and partially overlie the locking lugs.

The closure assembly thus provides a reliable two piece child-resistant closure. When the inner closure is removed and used separately, its skirt and plug combine to provide a secure frictional attachment of the inner closure to the container. The inner closure can be easily snapped off the container by an upwardly directed force on the skirt. It is immediately obvious that the inner closure used alone without the outer shell is not child-resistant.

DESCRIPTION OF THE PREFERRED EMBODIMENT

Figure 1:
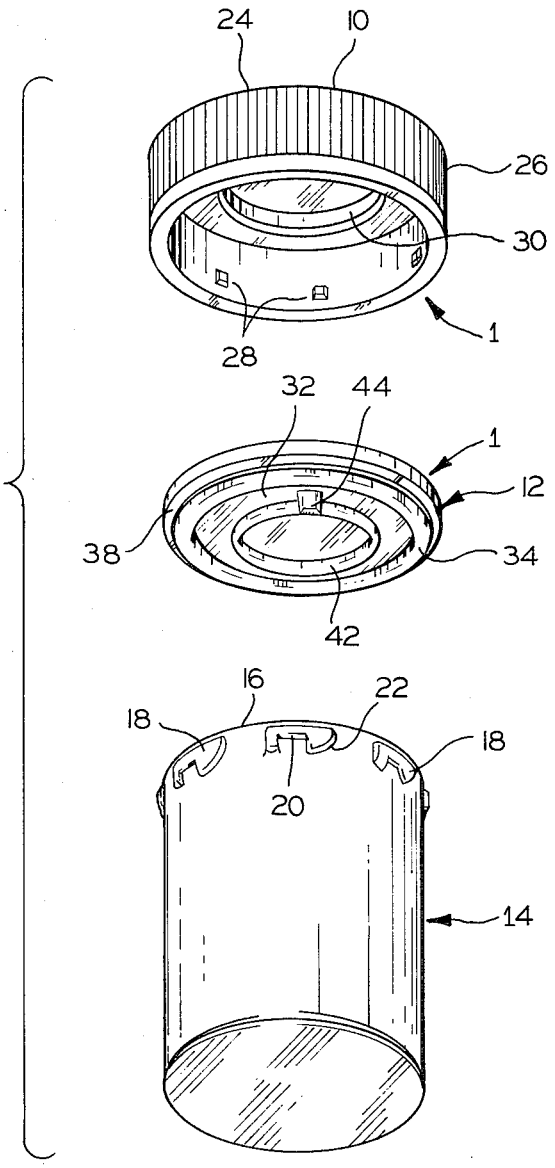
FIG. 1 is an exploded perspective view of a two piece convertable child-resistant closure assembly embodying the invention, with an associated container.

As illustrated in FIG. 1, the closure assembly 1 embodying the invention comprises an outer shell 10 and an inner resilient closure 12.

A cooperating container 14 comprises a generally cylindrical vessel having one open end terminating in a rim 16. The container includes a plurality of circumferentially spaced locking lugs 18 which project outwardly from the outside cylindrical surface of the container 14, adjacent the rim 16. Each lug 18 includes a downwardly opening notch 20, and a tapering camming surface 22.

The outer shell 10 is relatively rigid, and is preferably injection molded from a thermoplastic material such as polypropylene. The outer shell 10 comprises a top disc shaped panel 24 and an annular skirt 26 depending from the periphery thereof. A plurality of integrally formed, circumferentially spaced locking keys 28 project radially inwardly from the inside annular surface of the skirt 26. The circumferential spacing of the keys 28 corresponds to the circumferential spacing of the locking lugs 18 and notches 20, and the inside diameter defined by the innermost surfaces of the keys 28 is only slightly greater than the outside diameter of the container 14, whereby the keys 28 are engagable within the notches 20. As integral annular abutment 30 depends from the inside surface of the panel 24.

Figure 3:
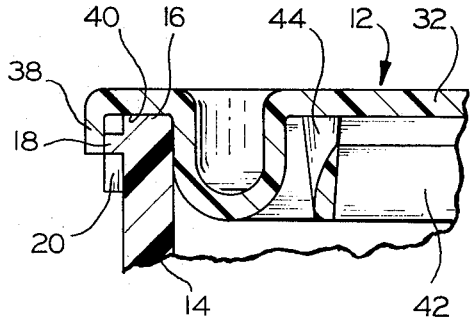
FIG. 3 is an enlarged scale sectional view of the inner closure only applied to the associated container.

The inner closure 12 is a generally disc shaped, integral, resilient member, preferably molded from a thermoplastic material such as polyethylene. The inner resilient closure includes a central panel 32, and a downwardly depending U-shaped annular plug 34. The plug is constructed and arranged for an interference fit within the annular rim 16 of the container 14. Beyond the circumference of the annular plug 34, the panel 32 continues with an annular portion 36 constructed and arranged to overlie the rim 16. A short annular skirt 38 depends from the periphery of the panel 32. As illustrated in FIG. 3, the skirt 38 of the inner resilient closure 12 extends downwardly sufficiently to overlie at least a portion of the locking lugs 18 of the container 14. When the closure 12 is applied, the annular channel 40 defined between the skirt 38 and the plug 34 snugly receives the rim 16 of the container 14.

The diameter of the inner resilient closure 12 is less than the inside diameter of the skirt 26, but greater than the inside diameter defined by the innermost surfaces of the keys 28. Hence, the closure 12 is normally retained within the outer shell 10 by the keys 28.

Grasping means are provided for the inner closure 12, comprising an integral handling ring 42. The ring 42 is integrally connected to the central panel 32 of the inner closure 12 by a single post 44 depending from the central panel 32.

Figure 2:
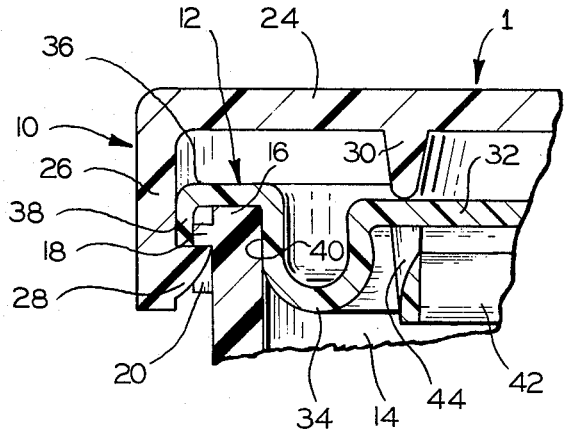
FIG. 2 is an enlarged scale sectional view of the closure assembly applied to the container in a child-resistant mode.

It is intended that the closure assembly 1 would be originally supplied to the consumer in the assembled, child-resistant mode illustrated in FIG. 2. To apply the child-resistant assembly 1, the skirt 26 of the outer shell 10 is disposed about the container rim 16, with the inwardly projecting keys 28 adjacent the outside cylindrical surface of the container 14, and between the locking lugs 18. The outer shell 10 is then rotated, causing the keys 28 to slide along the camming surfaces 22 until they are received within the notches 20. In this position, illustrated in FIG. 2, the inner closure 12 is resiliently deformed between the abutment 30 and the container rim 16. The restorative force of the deformed inner closure 12 provides an upward spring bias to the outer shell 10 which maintains the engagement of the keys 28 within the notches 20. To remove the closure assembly 1, it is first necessary to press the outer shell 10 downwardly relative to the container 14, thereby disengaging the keys 28 from the notches 20. The outer shell 10 is then rotated to clear the keys 28 from the lugs 18, and pulled axially off of the container 14. The required simultaneous pressing and turning motions are beyond the ability of young children.

If a consumer wishes to reseal the container 14 so that it is more easily opened, he can utilize the inner resilient closure 12 only. The handling ring 42 provides a convenient means for grasping the inner closure 12 and removing it from the outer shell 10. Once removed, the inner closure 12 can be applied to the container 14 in the manner of the conventional snap cap, as illustrated in FIG. 3. The channel 40 is constructed and arranged for a snug interference fit around the rim 16 and locking lugs 18 of a container 14. The closure 12 can be readily removed from the container 14 by simply pushing upwardly on the lower annular edge of the skirt 38, thereby snapping the closure 12 from engagement with the rim 16.

It is readily apparent that a container sealed by the inner closure 12 without the outer shell 10 is not child-resistant. However, for additional safety, the central panel 32 preferably includes suitable embossed or imprinted indicia warning that the closure 12 is not child-resistant.

The inner closure 12 performs two functions. In the child-resistant mode, the inner closure 12 provides the necessary spring bias for proper operation of the closure assembly 1. The provision of the plug 34, the shirt 38 and the handling ring 42 permit the inner closure also to be used independently as a closure which is not child-resistant.

Modifications of the invention will be readily apparent to those skilled in the art and it is intended that the scope of the invention be determined solely by the appended claims.

What is claimed is:

1. A child-resistant closure assembly for an open mouth container having an annular rim on the open end thereof, and circumferentially spaced locking lugs having downwardly opening notches, comprising: an outer shell, said outer shell including a circular panel section and an annular skirt depending from the periphery thereof, said skirt constructed and arranged to fit around the annular rim of the container, a plurality of integrally formed, and circumferentially spaced keys projecting inwardly from the inside annular surface of said skirt and constructed and arranged to fit within the notches of said locking lugs; and a resilient inner closure having an outside diameter larger than the inside diameter defined by the inner surfaces of said keys, whereby said inner closure is removably retained within said outer shell, said resilient inner closure including a central panel portion, an annular plug depending from said panel portion and constructed and arranged for an interference fit within said container rim, an annular skirt depending from the periphery of said central panel of said inner closure, said skirt and said plug defining between them an annular channel constructed and arranged to snugly receive the rim of said container, and grasping means on said inner closure to facilitate removal of said inner closure from said outer shell, comprising a handling ring integrally attached to the central portion of said inner closure within the circumference of said annular plug.

2. A child-resistant closure assembly for an open mouth container having an annular rim on the open end thereof, and circumferentially spaced locking lugs having downwardly opening notches, comprising: an outer shell, said outer shell including a circular panel section and an annular skirt depending from the periiphery thereof, said skirt constructed and arranged to fit around the annular rim of the container, a plurality of integrally formed, and circumferentially spaced keys projecting inwardly from the inside annular surface of said skirt and constructed and arranged to fit within the notches of said locking lugs; and a resilient inner closure having an outside diameter larger than the inside diameter defined by the inner surfaces of said keys for removably retaining it within said outer shell, said inner closure including a central panel portion, an annular plug depending from said panel portion and constructed and arranged for an interference fit within said container rim, an annular skirt depending from the periphery of said central panel of said inner closure, said skirt and said plug defining between them an annular snap cap fastening portion engageable annularly over the rim of said container adapted for independently securing said inner closure on said rim, and integrally formed handling means disposed on the underside of said inner closure panel portion and located within the circumference of said annular plug to facilitate separation and disassembly of said inner closure from said outer shell for its use as an independent closure for said container.

* * * * *